US006079248A

United States Patent [19]

Ballin

[11] Patent Number: 6,079,248

[45] Date of Patent: Jun. 27, 2000

[54] DRAWING PROCESS AND MACHINE

[76] Inventor: Felice Ballin, Via Silvio Pellico, 17 I-10040 San Gillio (Turin), Italy

[21] Appl. No.: 09/011,098

[22] PCT Filed: Jul. 12, 1996

[86] PCT No.: PCT/EP96/03067

§ 371 Date: Jun. 3, 1998

§ 102(e) Date: Jun. 3, 1998

[87] PCT Pub. No.: WO97/05972

PCT Pub. Date: Feb. 20, 1997

[30] Foreign Application Priority Data

Aug. 4, 1995 [IT] Italy ..... TO95A0655

[51] Int. Cl.[7] ..... B21C 1/24

[52] U.S. Cl. ..... 72/283; 72/287; 72/291

[58] Field of Search ..... 72/283, 282, 287, 72/290, 291, 278

[56] References Cited

U.S. PATENT DOCUMENTS 1,984,756 12/1934 Offutt ..... 72/283

3,257,833 6/1966 Good ..... 72/283

FOREIGN PATENT DOCUMENTS 3010942 10/1981 Germany ..... 72/291

130325 10/1980 Japan ..... 72/287

482223 8/1975 U.S.S.R. ..... 72/290

*Primary Examiner*—Daniel C. Crane

*Attorney, Agent, or Firm*—Keil & Weinkauf

[57] ABSTRACT

According to the invention, a drawing carriage is made to execute a forward stroke and a return stroke alternately, along longitudinal guides on a drawing bench, between two opposite drawing heads, each disposed in one end area of the said bench and each including at least one draw plate, by means of driving horizontally with a reciprocating motion. At least one piece to be drawn is pulled in each forward stroke and in each return stroke by the said drawing carriage, being made to pass through a corresponding draw plate in the drawing head from which the said carriage is made to move away. In this way, the carriage executes working strokes in both directions of horizontal movement along the corresponding guides, causing at least one piece to be drawn in each working stroke.

24 Claims, 3 Drawing Sheets

DRAWING PROCESS AND MACHINE

This application is a 371 of PCT/EP96/03067, filed Jul. 12, 1996.

The present invention relates to a process for drawing, for example, metal bars or tubes. The invention also relates to a machine for the application of the said process.

Conventional drawing machines have a main structure including:

- a working area (drawing bench), at one end of which is disposed a drawing head provided with a draw plate, and, before the drawing bench with respect to the direction of advance of the workpiece,
- an area for the loading of the blanks to be drawn, for example metal bars or tubes;
- an area for the insertion of a drawing mandrel in the case of metal tube drawing with a mandrel, and, after the drawing bench,
- an area for the discharge of the drawn pieces.

On the drawing bench, after the drawing head, a carriage is disposed slidably on longitudinal guides and is provided with clamp means to grip one end of a piece to be drawn, while it draws it through a corresponding draw plate, in each working stroke, to carry out the drawing operation.

The drawing carriage is made to execute its working stroke along the corresponding guides from an area in the proximity of the drawing head, by means of a chain (or similar means) continuously driven by motor means. The drawing carriage is temporarily coupled to the chain during the working stroke and is uncoupled from it at the end of the drawing operation.

At the end of the working stroke, in other words when the drawn piece has completely left the draw plate on completion of the drawing, the carriage, which is in an area remote from the drawing head, is stopped. It is then returned to the proximity of the drawing head, executing an idle return stroke, to grip with its clamp an end of another piece (bar or tube) to be drawn.

As will be clear from the above description, in each drawing cycle, one productive working stroke of the carriage is associated with a non-productive return stroke of the carriage. The cycle time for this drawing process is evidently unfavourable for mass production.

To increase the output for a given drawing cycle time, drawing machines known as "double or triple drawing machines" have been produced, with drawing heads having two or three draw plates each.

Consequently, two or three mandrels and the corresponding mandrel support means (for tube drawing) are provided, while the carriage is provided with two or three gripping clamps and the accessory and auxiliary devices of the machine are designed accordingly.

Although these "multiple draw" machines do in fact enable output to be increased, they do not resolve the problem of the idle times due to the non-productive return stroke of the carriage in each drawing cycle. Moreover, the mechanical means for driving the carriage translationally (for example, chain means), from which the carriage is uncoupled at the end of each operating stroke, has the disadvantage of a considerable noise level, often at the limits permitted by the current regulations in respect of noise in the workplace.

Indeed, the chain (or similar means) which is slightly raised from its travelling path by the driving hook connected to the carriage during the operating stroke, falls on to its travelling travelling path when the carriage is uncoupled, producing a loud mechanical noise.

Furthermore, the chain (or similar means) for driving the carriage translationally is kept constantly in motion, although it works only when the carriage is coupled to it. Its considerable weight and the consequent friction when it is idle therefore cause a considerable expenditure of energy, not used for work. However, it is impracticable to stop the.motion of the chain (or similar means) during the idle times, owing to the long stoppages required.

It should also be noted that the retooling of any known drawing machine, to change to the drawing of pieces having different dimensions and/or shapes, entails thie stopping of the machine to enable the equipment to be changed.

DE-A-30 10 942 and Be-A-372 968 seek to solve the technical problem of having, in each draw cycle, an unproductive return stroke of the carriage for each productive working stroke of the carriage, because the cycle time associated with such a drawing method is unfavorable for mass production.

The solution proposed in DE-A-30 10 942 and BE-A-372 968 is to provide a drawing method and machine in which at least two drawing carriages or benches travel in mutually opposite directions.

In DE-A-30 10 942, between two opposite draw plates, two bars are each drawn alternately by one carriage and by the other carriage, during their respective forward and return strokes, in such a way that said carriages cooperate in the operation of drawing each bar through a respective plate.

Each carriage is driven by its own translation driving device. In addition, each carriage is provided with jaw means for repeatedly gripping and releasing the bars at different points during the drawing process.

In BE-A-372 968 there are at least two drawing benches and a common drive device moving in a reciprocating manner, so that ore bench draws as the drive device moves in one direction, while the other bench draws as the device moves in the other direction.

The above solutions are structurally complicated and expensive.

In view of the above disadvantages of the knows drawing processes and machines, the present invention is designed to eliminate them.

In particular, one object of the present invention is to provide a process for drawing, for example, metal bars or tubes, which can eliminate the idle times due to the non-productive return stroke of the drawing carriage, thus increasing output and proportionately reducing the non-productive energy consumption.

Another object of the invention is to provide a drawing machine, for the application of the process according to the invention, which not only enables output to be increased, in the same conditions as the known machines, but which is also more reliable and efficient, as well as more versatile.

A further object of the invention is to provide a drawing machine as indicated, which enables the noise pollution inherent in known drawing machines to be drastically reduced, while also providing considerable energy savings for each unit of product.

An additional object is to provide a drawing machine as indicated which may be retooled to draw pieces of other types without stopping at least the partial operation of the machine.

To achieve these objects, the present invention provides a process for drawing, for example, metal bars or tubes whose essential characteristic forms the subject of claim 1, which is to be understood as being reproduced in full herein.

Furthermore, the present invention provides a drawing machine, whose essential characteristic forms the subject of claim 3, which is to be understood as being reproduced in full herein.

Further advantageous characteristics are described in the dependent claims which are also to be understood as being reproduced in full herein.

The process for drawing, for example, metal bars or tubes according to the present invention consists essentially in that a drawing carriage is made to executed a forward stroke and a return stroke alternately, along longitudinal guides on a drawing bench, between two opposite drawing heads, each disposed in one end area of the said bench and each including at least one draw plate, by means of driving translationally with a reciprocating motion; and in that at least one piece to be drawn is pulled in each forward stroke and in each return stroke by the said carriage, being made to pass through a corresponding draw plate in the drawing head from which the said carriage is made to move away, in such a way that the carriage executes working strokes in both directions of translational movement along the corresponding guides, causing at least one piece to be drawn in each working stroke.

The present invention is described in detail in the following text, with reference to the attached drawings, provided solely as a non-restrictive example, in which.

Figure 1:
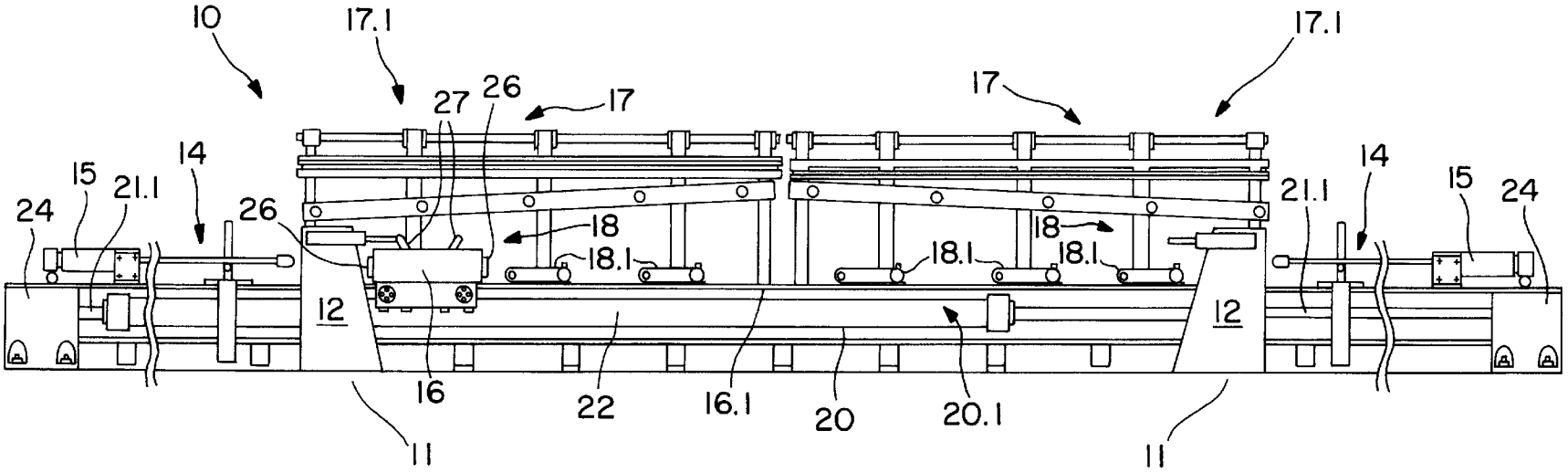
FIG. 1 is a schematic lateral elevation of an embodiment of the machine for drawing, for example, metal bars or tubes, for the application of the process according to the invention.
Figure 2:
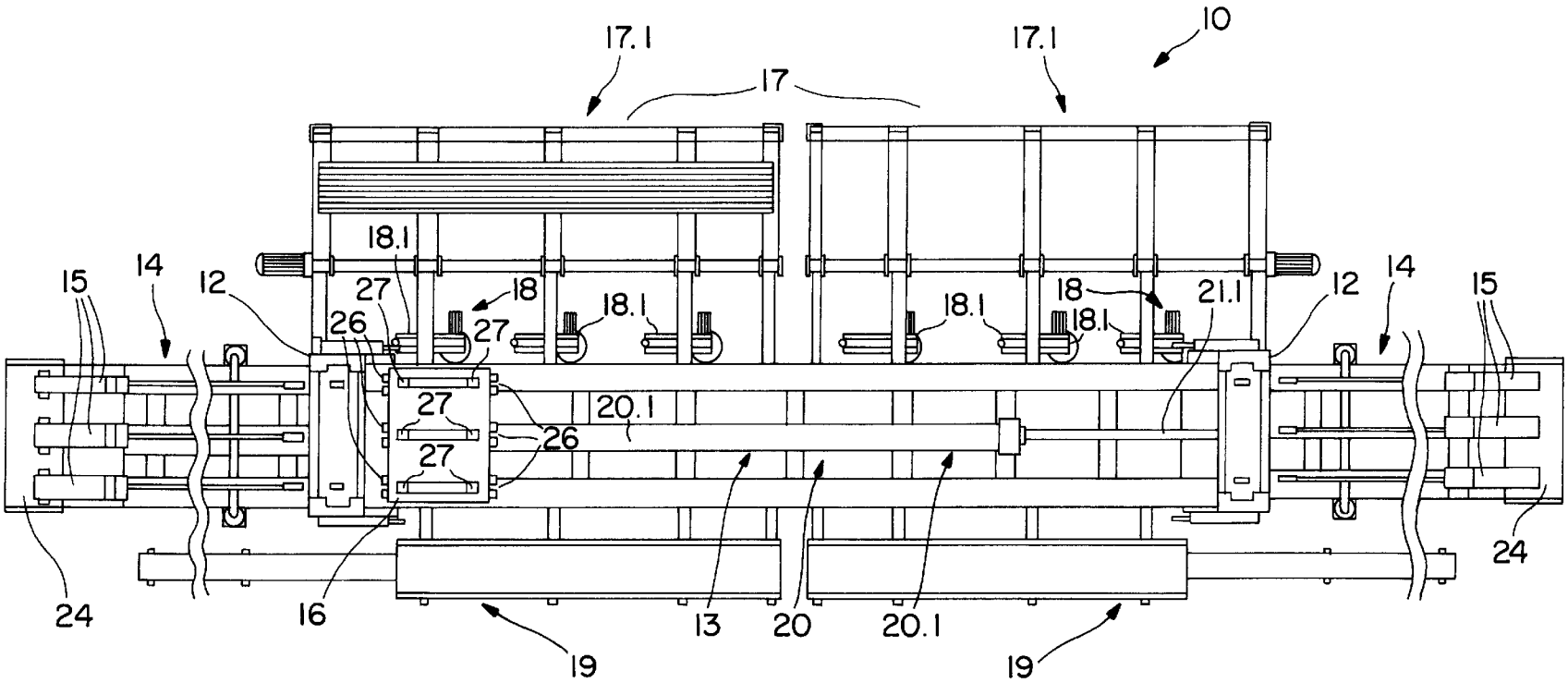
FIG. 2 is a plan view from above of the machine shown in FIG. 1.
Figure 3:
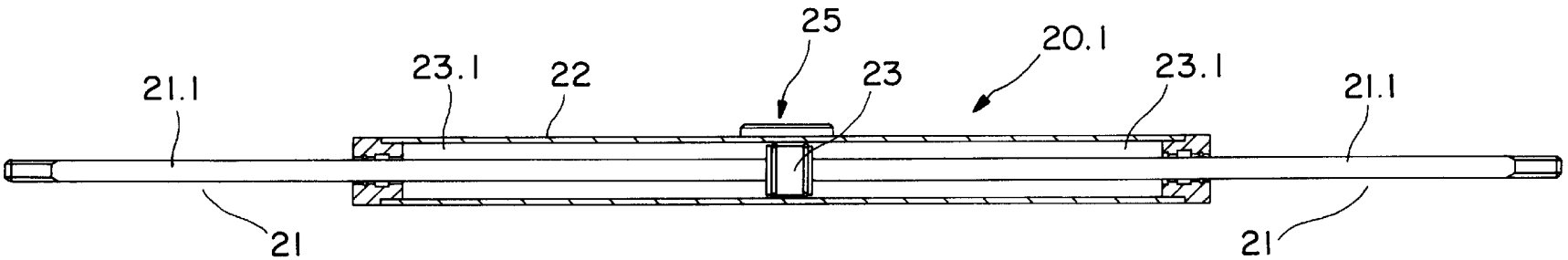
FIG. 3 is a schematic view, in axial section, of means of driving a drawing carriage horizontally, incorporated in the machine as shown in FIGS. 1 and 2.

With reference initially to FIGS. 1 to 3 of the drawings, the drawing machine, according to one embodiment of the present invention, is indicated as a whole by the number 10 (FIGS. 1 and 2).

It essentially comprises a main supporting structure 11 in the form of a drawing bench, provided at each of its ends with a draw plate support block 12. A central working area 13 is formed on the drawing bench 11, between the said blocks 12. The drawing blocks 12 are provided with reinforcing members to withstand axial, asymmetrical or symmetrical tractive forces.

With each block 12 there is associated, on the opposite side, in the longitudinal direction, from the drawing bench 11, a bench 14 for the loading and sliding of the blanks (for example, metal bars or tubes) to be drawn. Each bench 14 is provided, in an area remote from the corresponding block 12, with means 15 of inserting the drawing mandrel (for tubes) and for pre-loading the pieces.

The said construction substantially has mirror symmetry about a vertical transverse median plane of the main structure 11.

A carriage 16 for pulling the pieces during drawing is disposed slidably in the longitudinal direction, along corresponding rectilinear guides 16.1, in the working area 13 on the drawing bench 11.

Magazine means 17 for the storage and feed of the blanks to be drawn are provided, in the main structure 11, on one side and in a position elevated above the path of the drawing carriage 16 on the drawing bench. The said means 17 consist essentially of two frames 17.1 disposed with mirror symmetry about the said transverse vertical median plane of the main structure 11.

First discharge conveyor means 18 for the drawn pieces are disposed laterally with respect to the path of the drawing carriage 16, below the storage and feed magazine means 17.

Second discharge conveyor means 19 for the drawn pieces are disposed on the opposite side of the path of the drawing carriage 16 for the transport of the drawn pieces to storage cages. The said second conveyor means 19 are not illustrated in FIG. 1, for the sake of clarity of the illustration.

The said first and second discharge conveyor means 18 and 19 are also disposed with mirror symmetry about the said transverse vertical median plane of the main structure 11.

A draw plate support head (known and not illustrated), which will be discussed further below, is housed in each of the draw plate support blocks 12.

Means 20 of driving the carriage translationally along the guides 16.1 are provided in the main structure 11 under the path of the drawing carriage 16.

The said driving means 20 comprise a strong double-acting double-rod 21 hydraulic cylinder 20.1 (FIG. 3), with its axis parallel to the longitudinal direction of the main structure 11. The said hydraulic. cylinder 20.1 comprises a tubular casing 22, within which a piston 23 slides, with a seal, between two variable-volume driving chambers 23.1. The double rod 21 of the cylinder 20.1 consists of two coaxial rods 21.1, each being fixed at one end to the said piston 23, on the opposite side to the other, the rods being secured at their ends remote from the piston 23 to corresponding supports 24, fixed with respect to the main structure 11 and each being disposed beyond a corresponding loading bench 14. (The oil-hydraulic feed and operating means of the cylinder 20.1, which are well known, are not illustrated, for the sake of simplicity of illustration).

The casing 22 of the hydraulic cylinder 20.1 is provided with plate means 25 for connection to the drawing carriage 16, these means being disposed with mirror symmetry about the transverse median plane perpendicular to the axis of the casing.

The said drawing carriage 16 is provided at both its ends with three clamp devices 26 to grip three pieces (bars or tubes) to be drawn, at one end of each piece.

The drawing carriage 16 is also provided with rollers for running along the guides 16.1, the rollers being provided in a double train and on two axles, in such a way as to withstand the torsional and tractive forces, due to lack of balance of the load, which tend to make the carriage deviate from its rectilinear trajectory along the guides 16.1 during drawing.

The drawing carriage 16 is provided on its underside with means (not illustrated) for fixing to the. plate means 25 for connection to the hydraulic cylinder 20.1.

The said means of fixing the carriage 16 are constructed for a rigid or floating connection to the casing 22, in such a way as to permit a suitable distribution of the loads on the cylinder 20.1, in order to place the resultant of the forces along the axis of the cylinder.

The said means of fixing the drawing carriage 16 are also provided with a damping and shock-absorbing device (not illustrated), which absorbs, distributes and eliminates the excess forces of extraction of the drawn pieces from the draw plate at the end of the drawing operation.

The drawing carriage 16 is also provided with means 27 of automatic control of the opening and closing of the jaws of the clamp devices 26. The said automatic control means 27, of the lever type for example, interact with corresponding limit stops, projecting from each block 12 towards the working area 13.

The relative disposition of the stops and of the automatic control means 27 is such that, at the start of each stroke of the carriage 16, the three clamp devices 26 nearer the block 12 next to which the carriage 16 is positioned are made to close, to grip the pieces to be drawn, these pieces being engaged for drawing in the draw plates of the said block, while at the end of the stroke—when the drawing carriage 16 is stopped next to the other block 12—the said clamp devices 26 are made to open to release the drawn pieces, and the other clamp devices 26 are made to close, to grip, in turn, the pieces to be drawn which are engaged in the draw plates of the said other block 12.

The said automatic control means 27 may also be made in a servo-assisted hydraulic version, which, however, requires the installation of the necessary hydraulic circuit means.

A draw plate support head (known and not illustrated) is provided in each block 12. The two draw plate support heads are disposed with mirror symmetry about the transverse vertical median plane of the main structure 11.

Each draw plate support head is housed slidably in a corresponding socket to allow simple extraction for maintenance purposes.

Each draw plate support head is provided with three adjustable self-centring chucks which hold corresponding draw plates. The adjusting devices enable the draw plates to be orientated to regulate the drawing process.

The means 15 of insertion of the drawing mandrels are also disposed symmetrically about the transverse vertical median plane of the main structure 11, at the ends of the benches 14 remote from the structure.

The said means of inserting the mandrels 15 comprise hydraulic or pneumatic devices which enable each drawing mandrel (internal drawing tool) to be inserted, advanced and supported with respect to the corresponding drawing mandrel.

The mandrel is used in tube drawing, particularly in processes of internal forming and calibration.

The means 15 of inserting each mandrel are provided with three independent dispositions for operation with each draw plate.

The means 15 of inserting each mandrel, of the double-stroke type for example, may have an independent drive for each mandrel support device, or may have a single drive, in which case a suitable lever mechanism is provided for the distribution of the loads and of the strokes of the mandrels.

The storage and feed magazine means 17 may be manually operated, semi-automatic or automatic. The pieces to be drawn may be fed to the loading benches 14 from bundles of bars or tubes.

Loading means provided on the bench 14 enable the pieces to be drawn to be presented correctly to the drawing elements.

The tubes or bars to be drawn, in groups of three side by side, are propelled from the magazine means 17 by a powered roller or chain device over the drawing blocks 12 and along the loading benches 14, where, if necessary, the mandrels are inserted with the means 15.

The insertion of the three mandrels and the preparation of the tubes or of the bars to be drawn taker place simultaneously for the three blanks fed from time to time to each bench 14.

The said first discharge means 18 consist of a plurality of discharge conveyors 18.1 with toothed belts, rotated by independent three-phase asynchronous motors. The said discharge conveyors 18.1 are supported so that they can swing about corresponding vertical axes in a horizontal plane above the path of the drawing carriage 16, between a retracted idle position, in which they do not interfere with the said path, and a rotated operating position, in which they extend transversely with respect to the path. Each discharge conveyor 18.1 is associated with a control microswitch, operated by the carriage 16 during its stroke. Each discharge conveyor 18.1 remains swung into the idle position, outside the drawing bench 11, until the carriage 16 in the working stroke moves past it, operating the corresponding microswitch. The discharge conveyor 18.1 then swings into the work position, starts its belt, and is inserted under the tubes (or bars) which are being drawn, as soon as the carriage 16 has passed beyond the corresponding control microswitch.

The drawn pieces, when separated from the draw plate at the end of drawing, fall on to the discharge conveyor belts 18.1, which are already running and carry the pieces beyond the drawing bench 11, depositing them on the said second discharge conveyor means 19, which send them to a storage cage.

By the use of suitable detector means, the discharge into the storage cage of the third drawn piece of every set of three pieces to be drawn pulled by the drawing carriage 16 causes the operation to stop and causes the discharge conveyors 18.1 to swing into the idle position.

The drawing machine 10 is electrically connected to an electricity supply network for industrial use and to a compressed air supply network for industrial use.

Each driving chamber 23.1 of the hydraulic cylinder 20.1 is hydraulically supplied alternately, by means of a suitable hydraulic installation comprising one or more hydraulic power units with corresponding constant-pressure and variable-delivery pump means which may be servocontrolled.

The hydraulic installation disposition with two hydraulic power units, for example, enables one pump to be dispensed with, to reduce power consumption, with "intakes" which require low power. This disposition also makes it possible not to interrupt the operation of the machine in case of failure of one of the hydraulic power units.

Remote control means, which are known and are not illustrated, enable an operator to control the operation of the machine 10. They essentially comprise an electrical supply box for the services and drives and a logic box, in a wired relay version or a PLC version.

There is also a control panel (also known and not illustrated) for setting the operating modes of the machine 10 and for the control of the manual movements and cycles.

The drawing machine 10 may be provided with various accessory means, such as:

- automatic or manual means of butting for tubes or bars;
- automatic or manual means of trimming the ends of the pieces to be drawn or of the drawn pieces;
- automatic or manual means of cutting tubes or bars on reels to size;
- automatic means of longitudinal straightening of bars or tubes;
- marking means.

The machine 10 may also be used to draw tubes or bars with a non-circular, open or closed cross-section, and tubes with walls consisting of more than one layer.

The machine 10 has a high output, owing to the double working stroke of the carriage 16 for each drawing cycle, without idle time due to the idle return movement: which takes place in conventional machines.

The principal advantages of the drawing machine according to the present invention may be summarized as follows, the means of driving the drawing carriage translationally with a reciprocating motion and the working cycle of the machine being considered separately:

a) Advantages derived from the means of driving the drawing carriage translationally.

The means of driving the drawing carriage translational with a reciprocating motion, such as the hydraulic cylinder 20.1, are structurally simple and reliable.

The speed of the horizontal movement of the drawing carriage may be regulated continuously, for example by variable-delivery pump means.

The absence of chain (or similar) means of traction of the drawing carriage kept in continuous circulation reduces the wear on the mechanical components, simplifies maintenance and reduces its costs.

The absence of chain (or similar) means of traction of the drawing carriage kept in continuous circulation reduces the mass of machinery in motion, decreases the expenditure of passive energy, in other words that not used directly for the drawing operation. For lower outputs, it is possible to use only one of the two working strokes of the drawing carriage and the passive energy expended, in this case, is only that of the displacement of the mass of the carriage and the friction of its rollers.

The absence of chain (or similar) means of traction of the drawing carriage kept in continuous circulation, and of moving drive gearing or gearmotors, considerably diminishes the noise level of the machine.

The number of moving mechanical parts is reduced, so that the inertia of the machine and consequently the acceleration periods and energy consumption are correspondingly reduced.

The regulation of the hydraulic power units supplying the driving cylinder makes it possible to have speed patterns which are variable during drawing, for example a low speed at the start of the drawing operation and at the time of the insertion of the piece to be drawn, followed by speeds gradually increasing to the maximum permitted by the process in use and by the type and section of the blank which is being drawn.

A double hydraulic power unit supplying the driving cylinder makes it possible to operate with energy savings 15 in the case of drawing operations which require low power. It is also possible to continue to work with only one hydraulic power unit in case of a failure of the other.

Emergency action can be taken instantaneously by discharging the hydraulic actuator.

b) Advantages derived from the operating cycle of the machine according to the invention.

The structure of the machine according to the invention makes it possible to have, for each stroke of the drawing carriage between the two draw plate support blocks, a corresponding working stroke, without idle return, providing a higher output.

The fact that the carriage does not return rapidly in the idle state (as is the case in conventional machines), but slowly while executing another working stroke, also enables the machine operator to work in greater safety and to have more time for supervising or monitoring the phase of preparation of the material to be drawn (a semi-automatic or manual process).

The high output yields shorter pay-off times.

The possibility of working with two drawing heads enables one head to be tooled while drawing continues with the other head. Similarly, the adjustment of the tooling and of the process may take place at one head, while drawing continues with the other head. In this way the idle times due to retooling are reduced.

Figure 4:
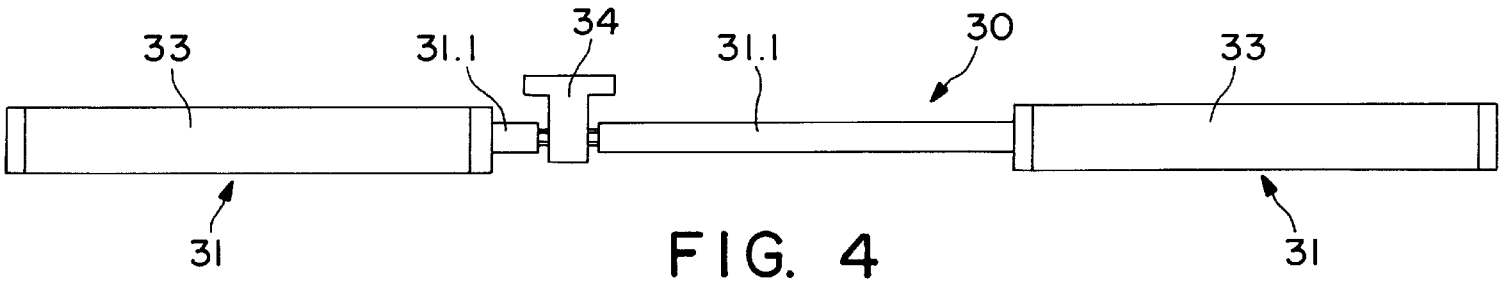
FIG. 4 is a schematic elevation of a variant embodiment of the said means of driving the drawing carriage translationally.

FIG. 4 shows a variant embodiment of the means of driving the drawing carriage translationally along the corresponding guides.

According to this variant, the said means of driving translationally, indicated as a whole by the number 30, comprise a pair of single-acting hydraulic cylinders 31 coaxial with each other and with corresponding opposing rods 31.1. The axis of the said hydraulic cylinders is parallel to the longitudinal direction of the drawing bench. The casing 33 of each hydraulic cylinder 31 is fixed with respect to a fixed support (not illustrated), remote from the drawing bench, while the opposing rods 31.1 of the said cylinders 31 are fixed at their free ends at opposite sides of a structure 34 for the connection of the drawing carriage.

The driving chambers of the said hydraulic cylinders 31 are supplied with hydraulic fluid in an opposite way to each other, by means of a suitable hydraulic installation comprising one or more hydraulic power units with corresponding constant-pressure variable-delivery pump means. In this way, the hydraulic cylinders 31 work in a push-pull mode with each other; in other words, as the rod 31.1 of one cylinder 31 is extended, that of the other cylinder is correspondingly retracted.

By this arrangement, the drawing carriage is made to execute forward and return strokes along the guides 16.1 on the drawing bench, with a reciprocating motion, between the drawing blocks.

Naturally, numerous other changes may in practice be made to what has been described and illustrated without restriction and solely by way of example, without departure from the scope of the invention and consequently from the domain of the present industrial patent.

For example, the said means of driving translationally may comprise at least one flexible transmission member (for example, a chain or belt) run round. and stretched between pulleys, connected to the drawing: carriage and made to run by asynchronous motors and inverter devices, or by d.c. or brushless servomechanisms, in such a way that it imparts a reciprocating rectilinear motion to the carriage along the corresponding guides.

The drawing machine according to the present invention may also form, with the accessory means indicated above, an automatic and independent work station capable of producing precision drawn bars or tubes from rough-shaped blanks.

The machine may also be incorporated in a complex and highly automated production line, for example in a steel production plant, to execute a complete production cycle from the raw material supplied from bar rolling-mills or from tube production lines to the final precision drawn product.

I claim:

1. A process for drawing metal bars or tubes from blanks in which a drawing carriage (16) of a drawing machine (10) executes a forward stroke and a return stroke alternately along longitudinal guides (16.1) on a drawing bench (11) between two opposite drawing heads, each of which drawing heads is disposed in one end area (12) and each of said drawing heads includes at least one draw plate, driving said drawing carriage (16) with a reciprocating motion translationally along said longitudinal guides (16.1) between said drawing heads pulling at least one blank to be drawn in each forward stroke and in each return stroke, passing the blank wholly through a corresponding draw plate in the drawing head from which the said carriage (16) is made to move away, such that said carriage (16) executes working strokes in both directions of tranlational movement along the corresponding guides (16.1) at least one blank to be drawn in each working stroke, characterized in that the speed of translational movements of the drawing carriage is continuously regulated by hydraulic means utilizing a variable-delivery pump means providing variable speed patterns during the drawing.

2. The process of claim 1 wherein at the start of the variable speed pump is controlled such that it proves a low speed at the start of the drawing followed by speeds gradually increasing to the optimum speed.

3. A drawing machine for drawing metal bars or tubes from blanks comprising a drawing bench (11), a drawing carriage (16) disposed slidably along longitudinal guides (16.1) between two drawing heads, each of which drawing heads is located at an opposite end area (12) of the drawing bench (11), each drawing head including at least one drawing plate, means for driving said drawing carriage (16) with a reciprocating motion translationally along said longitudinal guides (16.1) between said drawing heads and pulling at least one blank to be drawn in each forward stroke and in each return stroke, means for passing the blank wholly through a corresponding draw plate in the drawing head from which the said carriage (16) is made to move away such that said carriage (16) executes working strokes in both directions of tranlational movement along the corresponding guides (16.1) at least one blank to be drawn in each working stroke, such that said carriage (16) executes working strokes in both directions of tranlational movement along the corresponding guides (16.1) so that at least one blank is drawn in each working stroke, and wherein said means for driving (20, 30) said drawing carriage (16) transitionally along said longitudinal guides (16.1) comprises at least one hydraulic cylinder (20.1, 31) connected to said carriage (16), said hydraulic means being equipped with a variable-delivery pump means for providing variable speed patterns during the drawing.

4. Drawing machine according to claim 3, characterized in that a bench (14) for the loading and sliding of the blanks to be drawn is associated with each drawing head on the opposite side, in the longitudinal direction from the drawing bench (11).

5. Drawing machine according to claim 4, characterized in that the structure including the drawing bench (11), drawing heads, loading benches (14) and means (15) of inserting the drawing mandrel and/or of preloading the pieces to be drawn has, substantially, mirror symmetry about a transverse vertical median plane of the said drawing bench (11).

6. The machine according to claim 4 wherein each loading bench (14) is provided with a means (15) for inserting a drawing mandrel, for drawing tubes and/or for pre-loading the pieces to be drawn, wherein the said means (15) includes means for inserting, means for advancing, means for and means for supporting each drawing mandrel with respect to the corresponding drawing mandrel.

7. Drawing machine according to claim 6, characterized in that the machine comprises first conveyor means (18) for discharging e drawn pieces, disposed along the path of the drawing carriage (16) and including a plurality of discharge conveyors (18.1).

8. Drawing machine according to claim 7, characterized in that the machine comprises second conveyor means (19) for discharging the drawn pieces fed from the said first discharge conveyor means (18), disposed along the path oil the drawing carriage (16) to convey the drawn pieces to storage cages, and comprising a plurality of discharges conveyors (19.1).

9. Drawing machine according to claim 7, characterized in that the said first discharge conveyor means (18) consist of a plurality of discharge conveyors (18.1), with toothed belts which are supported so that they can swing about corresponding vertical axes in a horizontal plane above the path of the drawing carriage (16), between a retracted idle position, in which they do not interfere with the said path, and a rotated operating position, in which they extend transversely with respect to the path.

10. Drawing machine according to claim 9, characterized in that each discharge conveyor (18.1) is associated with a control means comprising a microswitch, operated by the carriage (16) during its stroke, and in that each discharge conveyor (18.1) remains swung into the idle position until the carriage (16) in the working stroke moves past it, triggering the corresponding control means and causing it to come into operation and to swing into the working position as soon as the carriage (16) has passed beyond the said control means, in such a way that each drawn piece, when separated from the draw plate at the end of drawing, falls on to the said discharge conveyors (18.1), which carry the piece beyond the drawing bench (11), depositing it on the said second discharge conveyor means (19), which send it, to a storage cage, while the discharge from the said second conveyor means (19) of the last piece drawn for each working stroke of the drawing carriage (16) causes, by detector means, the discharge conveyors (18.1) to stop and to swing back into the idle position.

11. Drawing machine according to claim 7, characterized in that the discharge conveyors (18.1) of the said first discharge conveyor means (18) are disposed with mirror symmetry with respect to each other about the transverse vertical median plane of the drawing bench (11), and in that the discharge conveyors (19.1) of the said second discharge conveyor means (19) are disposed with mirror symmetry with respect to each other about the said vertical median plane of the drawing bench (11).

12. Drawing machine according to claim 6, characterized in that each drawing head is provided with a plurality of adjustable self-centering chucks which hold corresponding draw plates, in such a way that the means of adjustment enable the draw plates to be orientated to regulate the drawing process.

13. Machine according to claim 12, characterized in that the said means (15) of inserting each mandrel are provided with a plurality of independent dispositions for operation with each draw plate.

14. Drawing machine according to claim 12, characterized in that the said means (15) of inserting each mandrel comprise an independent drive for each mandrel support device.

15. Drawing machine according to claim 12, characterized in that the said means (15) of inserting each mandrel comprise a single drive for each mandrel support device, provided with a lever mechanism for the distribution of the loads and of the strokes of the mandrels.

16. Drawing machine according to claim 3, characterized in that the said drawing carriage (16) is connected to at least one hydraulic cylinder (20.1, 31) by connecting means (25, 34), permitting a suitable distribution of the loads on the cylinder in such a way that the resultant of the forces is placed along the axis of the said cylinder.

17. Drawing machine according to claim 16, characterized in that the said means of fixing the drawing carriage (16) are provided with a damping and shock-absorbing device which absorbs, distributes and eliminates the excess forces of extraction of the drawn pieces from the draw plate at the end of the drawing operation.

18. The machine according to claim 3, wherein the at least one hydraulic cylinder (20.1,31) is disposed under the path of the carriage along said drawing bench.

19. Drawing machine according to claim 18, characterized in that the said driving means (20) comprise a double-acting double-rod (21) hydraulic cylinder (20.:L) with its axis parallel to the longitudinal direction of the drawing bench (11).

20. Machine according to claim 19, characterized in that the said hydraulic cylinder (20.1) comprises a tubular casing (22), within which a piston (23) slides, with a seal, between two driving chambers (23.1), and a double rod (21), consisting of two coaxial rods (21.1), each fixed at one end to the said piston (23), on the opposite side to the other, the rods being secured at their ends remote from the piston (23) to corresponding supports (24), fixed with respect to the drawing bench (11); and in that the casing (22) of the said hydraulic cylinder (20.1) is provided with means (25) for connection to the drawing carriage (16), these means being disposed with mirror symmetry about the transverse median plane perpendicular to the axis of the said casing.

21. Drawing machine according to claim 18, characterized in that the said driving means (30) comprise a pair of single-acting hydraulic cylinders (31) coaxial with each other and with corresponding opposing rods (31.1), disposed under the path of the said drawing carriage (16) along the drawing bench (11), the axis of the said hydraulic cylinders being parallel to the longitudinal direction of the drawing bench; in that the casing (33) of each hydraulic cylinder (31) is connected to a fixed means of support fixed with respect to thus drawing bench, while the opposing rods (31.1) of the said cylinders (31) are connected at their free ends to opposite sides of a structure (34) for connection to the drawing carriage (16); and in that the driving chambers of the said hydraulic cylinders (31) are supplied with hydraulic fluid in an opposite way to each other, in such a way that the hydraulic cylinders (31) work in a push-pull mode with each other, such that, as the rod (31.1) of one cylinder (31) is extended, that of the other cylinder is correspondingly retracted.

22. Drawing machine according to claim 18, characterized in that the said hydraulic means (20.1, 31) for driving the drawing carriage (16) translationally are supplied with hydraulic fluid from a hydraulic installation comprising at least one hydraulic power unit with corresponding constant-pressure variable-delivery pump means, which is servocontrolled, and which enable the speed of horizontal movement of the drawing carriage to be regulated continuously.

23. A drawing machine according to claim 18 wherein the drawing machine includes a magazine means (17) for storage of the blanks to be drawn and a means for feeding the blanks to said loading benches (14), each of these means being provided on one side and raised above the path of the drawing carriage (16) and in a position raised above the path of the drawing carriage (16) on the drawing bench (11) and wherein the magazine means (17) for storage and feeding the blanks comprise two frames (17.1) disposed with mirror symmetry about the transverse vertical median plane of the drawing bench.

24. Drawing machine according to claim 3, in which the said drawing carriage (16) is provided at both its end areas with corresponding clamp devices (26) so that each of these can grip at least one piece to be drawn and is provided with means (27) of automatic control of the opening and closing of the jaws of the said clamp devices (26), characterized in that the said automatic control means (27), are lever mechanical means and interact with corresponding limit stops associated with each drawing head, in such a way that at the start of each stroke of the drawing carriage (16) each clamp device (26) nearer the drawing head next to which the carriage (16) is positioned is made to close, to grip a corresponding piece to be drawn, the piece being engaged for drawing in a draw plate of the said block, while at the end of the stroke, when the drawing carriage (16) is stopped next to the other drawing head, the said clamp device (26) is made to open to release the drawn piece.

* * * * *

UNITED STATES PATENT AND TRADEMARK OFFICE

CERTIFICATE OF CORRECTION

PATENT NO.: 6,079,248

DATED: June 27, 2000

INVENTOR(S): Felice BALLIN

It is certified that error appears in the above-identified patent and that said Letters Patent is hereby corrected as shown below:

On the title page,

Item [30] on the cover sheet, the priority application should read:
--TO95A000655--.

Col. 9, claim 7, line 64, "the machine" should be --it--.

Col. 9, claim 7, line 65, "e" should be --the--.

Col. 10, claim 8, line 4, "oil" should be --of--.

Col. 10, claim 8, line 6, "discharges" should be --discharge--.

Col. 11, claim 19, line 14, "(20.:L)" should be --(20.1)--.

Col. 11, claim 21, line 39, "thus" should be --the--.

Signed and Sealed this

Third Day of April, 2001

*Attest:*

Nicholas P. Godici

NICHOLAS P. GODICI

*Attesting Officer*

*Acting Director of the United States Patent and Trademark Office*